United States Patent [19]

Lopez

[11] 4,337,937

[45] Jul. 6, 1982

[54] ARM MUSCLE EXERCISER DEVICE

[76] Inventor: Rafael E. Lopez, 1924 Fairhaven St., Lemon Grove, Calif. 92045

[21] Appl. No.: 112,473

[22] Filed: Jan. 16, 1980

[51] Int. Cl.[3] ..... A63B 21/22

[52] U.S. Cl. ..... 272/67; 272/132; 403/379

[58] Field of Search ..... 272/67, 68, 132, DIG. 3, 272/DIG. 4; 305/11; 301/1, 9 CN, 111, 112, 113; 411/104, 105, 200, 199, 294, 213, 209, 208, 217; 403/379

[56] References Cited

U.S. PATENT DOCUMENTS

| | | | |
|---|---|---|---|
| 684,117 | 10/1901 | Sloan | 272/68 |
| 1,604,333 | 10/1926 | Anderson | 272/68 |
| 2,668,055 | 2/1954 | Sharp | 272/68 |
| 2,973,962 | 3/1961 | Griffin | 272/68 |
| 3,184,234 | 5/1965 | Strable | 272/68 |
| 3,211,453 | 10/1965 | Williams | 272/68 |
| 3,409,336 | 11/1968 | Dadds | 305/11 |
| 3,525,522 | 8/1970 | Pillar | 272/132 X |
| 3,830,493 | 8/1974 | Miller | 272/67 |
| 4,186,920 | 2/1980 | Fiore | 272/96 |

*Primary Examiner*—Richard J. Johnson

*Attorney, Agent, or Firm*—Bruno J. Verbeck; Michael L. Slonecker

[57] ABSTRACT

A rotatively manipulable arm, hand and wrist exercise device comprising at least two grippable handle elements surmounted upon a longitudinally extended shaft having means at one end thereof to retain said handles in abutting relationship. Said shaft further projects beyond the handle assembly, and is threaded along a portion of its projecting or distal end whereby to conformably accommodate thereon an axially adjustable housing. By manually adjusting said housing, friction-producing means are caused to engage and sufficiently compress the handle elements whereby to create torsional resistance opposing the relative counter rotation of said handles.

4 Claims, 5 Drawing Figures

ARM MUSCLE EXERCISER DEVICE

BACKGROUND OF THE INVENTION

The present invention relates to an exercise device, and more particularly to an arm, hand and wrist exercise device of the general type wherein friction-producing means are utilized to compress abutting rotatable handles, thereby to create torsional resistance.

While numerous devices utilizing compressive force to generate torsional resistance are known to the art, such devices generally employ a multiplicity of springs, friction-producing washers, and/or threaded elements to provide the desired level of resistance acting to oppose the relative movement of said handle elements. As representative examples of such devices, see: Anderson, U.S. Pat. No. 1,604,333; Sharp, et al., U.S. Pat. No. 2,668,055; Griffin, U.S. Pat. No. 2,973,962; Strubel, U.S. Pat. No. 3,184,234; and Hughes, U.S. Pat. No. 3,717,338.

A problem inherent in some of these devices resides in the fact that, although friction-producing means are used to initially establish a desired level of torsional resistance, relative movement between the grippable handle elements may cause said means to work loose. Still further, yet another problem associated with some of these devices derives from the multiplicity of parts incorporated into the construction of the mechanisms, thereby serving to complicate the device and increase the cost for producing the same.

Thus, it is a primary object of the present invention to provide axially adjustable friction-producing means which will continuously maintain desired levels of torsional resistance despite relative movement of the handle elements.

Still further, another object is to provide an improved exercise device utilizing a minimum number of parts whereby to simplify construction and reduce construction costs.

SUMMARY OF THE INVENTION

The present invention is directed to an arm, hand and wrist exercise device of the general type hereinbefore described. It has, as a characterizing feature, friction-producing means which, when set to generate a desired level of torsional resistance, will continuously maintain said resistance level as grippable elements are counter-rotated.

Briefly stated, the present invention comprises at least two grippable handle elements surmounted upon a longitudinally extended shaft having means at one end thereof to retain said handles in an abutting relationship. Said shaft further projects beyond the opposite end of the handle elements assembly and is threaded along a portion of said projecting or distal end whereby to permit the conformable accommodation thereon of an axially adjustable housing.

Friction-producing means surmount said shaft and are interposed between said handle elements assembly and the adjustable housing. In order that said means will continuously maintain a desired level of torsional resistance, said means are secured to the shaft in a manner permitting axial movement along the shaft while simultaneously restricting rotational movement thereabout. Thus, once the desired level of resistance is set, frictional forces generated during the use of the device will not cause the friction-producing means to work loose.

Additional features of the invention will become apparent from the following detailed description as taken in conjunction with the accompanying drawings.

DESCRIPTION OF THE PREFERRED EMBODIMENT

Figure 1:
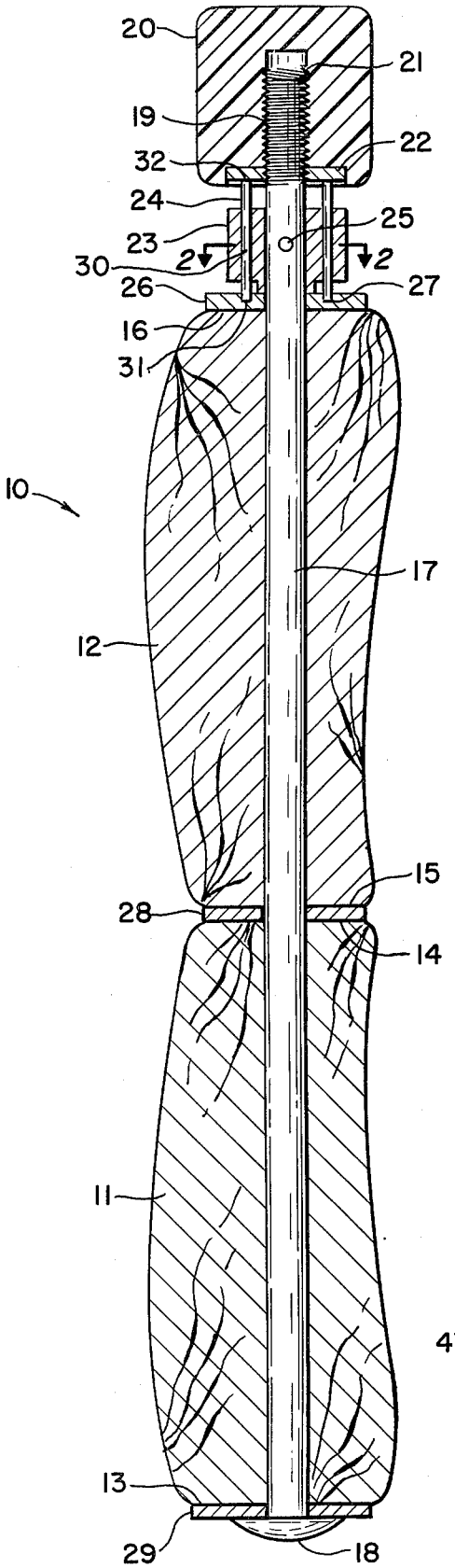
FIG. 1 is a longitudinal cross-section view of the preferred embodiment for my arm, hand and wrist exercise device.

So that my invention may be more readily understood, reference is now made to the accompanying figures wherein like reference numerals refer to like parts throughout the several views.

Referring particularly to FIG. 1, therein is shown a cross-sectional view of the preferred embodiment for my exercise device 10. Beneficially, device 10 comprises at least two substantially identical, grippable handle elements, namely a first handle 11 and a second handle 12, each having an axial bore extending therethrough whereby the handles may be surmounted in abutting relationship upon a longitudinally extended shaft 17.

Manifestly, a wide variety of materials and/or configurations may be used to construct the handle elements, wood or plastics generally being preferred due to ease of fabrication and relatively low cost. The criteria for selecting a particular design configuration for said elements principally relates to two parameters. First, the handles must be of sufficient size and cross-section to permit a comfortable, but firm, grasp thereon. Finally, said handles must further exhibit a sufficiently high coefficient of friction upon their exposed surfaces whereby axially applied compressive forces will generate adequate levels of torsional resistance upon the surfaces engaging friction-producing elements. Thus, it is to be appreciated that any material, in addition to wood or plastic, satisfying these criteria may be utilized for the handle elements.

Shaft 17 comprises a longitudinally extended rod of metal or the like, of sufficient length to translate through, and project beyond, said handle elements assembly. A retainer 18, which is preferably in the form of a flange and an integral part of shaft 17, also of metal or the like, engages the sidewall 13 of handle 11. In addition to retaining the handle elements assembly in position on shaft 17, retainer flange 18 further provides a friction-producing surface opposing the rotational movement of the handles. While FIG. 1 shows a friction-producing washer 29 interposed between sidewall 13 and retainer 18, it is included therein for illustrative purposes only, and it need not be included in the preferred embodiment if retainer 18 is of adequately large diameter to engage a major portion of sidewall 13.

The projecting or distal end 19 of shaft 17 is threaded along a substantial portion thereof, and conformably accommodated within an adjustable housing member 20 having a threaded recess 21. It is to be appreciated that manual rotation of housing member 20 about shaft 17 causes said housing member to axially translate relative to the shaft and engage friction-producing means, described below, surmounting shaft 17 between housing member 20 and the handle elements assembly. Thus, compressive force may be controllably translated to the handle elements, thereby producing desired levels of torsional resistance.

Figure 2:
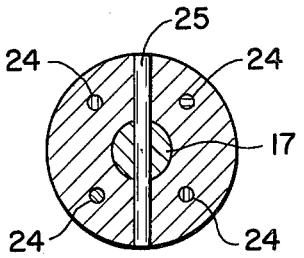
FIG. 2 is a cross-section view of the frictionproducing means taken along line 2—2 in FIG. 1.

The friction-producing means of my preferred embodiment beneficially comprises a non-rotating, axially translatable assembly cooperatively communicating with both the handle elements assembly and housing member 20. As shown in FIGS. 1 and 2, said means comprises a sleeve 23 surmounting shaft 17 and secured thereto by a pin 25 or the like whereby to prevent movement of the sleeve 23 relative to the shaft 17. So that compressive force generated by rotation of housing member 20 may be communicated to the handle elements assembly, said means further comprises a multiplicity of axially translatable pressure rods 24 disposed through bores 30 in sleeve 23 and a pressure plate 26 cooperating with a terminal end 31 of each of said rods.

Figure 3:
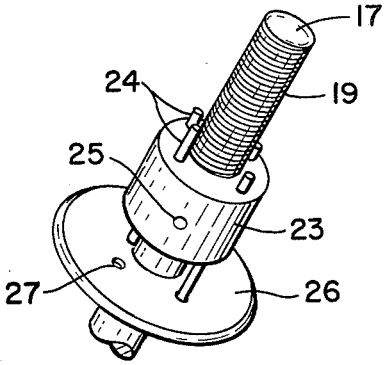
FIG. 3 is a perspective view of the frictionproducing means shown in FIGS. 1 and 2.

As shown more fully in FIG. 3, conformable recesses 27 are partially disposed through pressure plate 26 whereby to accommodate a portion of the terminal ends 31 of rods 24 therein. The inclusion of recesses 27 is preferred, though not essential, inasmuch as said recesses prevent plate 26 from rotating as handles 11 and 12 are relatively counter-rotated, thus insuring that torsional resistance is generated across the entire surface area of pressure plate 26 in contiguous relationship with sidewall 16.

Referring again to FIG. 1, the opposite terminal end 32 of each of said rods 24 further cooperates with a washer 22 contained within housing member 20. The use of washer 22 is desirable for the practice of my invention, inasmuch as it serves to facilitate the manual adjustment of housing member 20 by reducing the frictional resistance between said housing member and said terminal ends 32. Such washer is, however, not essential and may be omitted, terminal ends 32 thereby cooperating directly with housing member 20.

It is to be appreciated that as housing member 20 is manually rotated about shaft 17, said housing member is caused to engage the friction-producing means of FIGS. 1, 2 and 3 and translate compressive force to the handle elements assembly. As said handle elements are compressed, sidewalls 13, 14, 15 and 16 are caused to cooperate with said pressure plate 26 and friction-producing washers 28 and 29. Thus, variable levels of compressive force may be controllably applied thereby to enable said device to generate torsional resistance opposing the relative counter-rotation of handles 11 and 12.

Further, by securing said friction-producing means to permit only axial adjustment along said shaft 17, movement of housing member 20 is inhibited during the operation of my device thereby continuously maintaining the desired level of torsional resistance.

Figure 4:
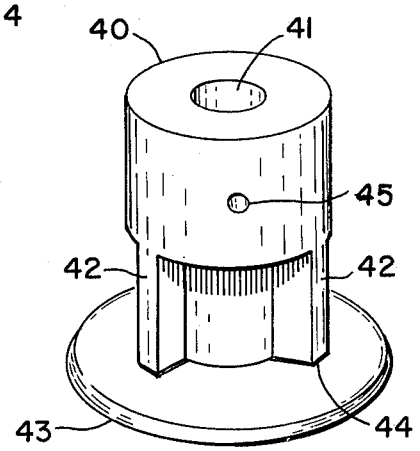
FIG. 4 is perspective view of an alternate embodiment for friction-producing means amenable for use with my exercise device.

It should be understood that any axially adjusable and non-rotatable friction-producing means may be effectively employed with my device. Thus, FIG. 4 depicts an alternate embodiment of a friction-producing means whereby axially adjustable compressive force may be transmitted to the handle elements assembly. More specifically, said means comprises a sleeve 40 having a bore 41 extending therethrough of sufficient diameter to permitting mounting upon an elongated shaft (not shown). Further, sleeve 40 is provided with a multiplicity of integral appendages 42 accommodated within conformable recesses 44 partially disposed through pressure plate 43. Said pressure plate 43 serves the identical function in the preferred embodiment, i.e., transmitting compressive force to the handle elements and generating the torsional resistance acting to oppose the relative counter-rotation of said handles.

Figure 5:
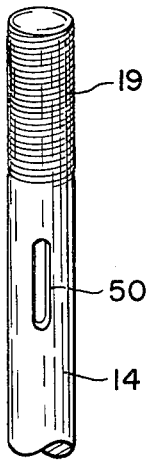
FIG. 5 is a perspective cut-away view of the longitudinally extended shaft more fully illustrating the manner by which the friction-producing means of FIG. 4 may be secured to said shaft while further permitting the axial adjustment of said means.

In order to permit the axial adjustment of said means while concurrently inhibiting rotational movement about the shaft, FIG. 5 shows an elongated slot 50 disposed through shaft 17. Thus, a pin 45 or the like, as shown in FIG. 4, may be radially extended through sleeve 40 and said slot 50.

Based upon the foregoing discussion, it is thus to be appreciated that the present invention comprises a simple and unique device for the flexural exercise of arm, hand and wrist muscles which, insofar as the applicant is aware, is unknown to the art. While a preferred and alternate embodiment of the invention has been illustrated and described herein, it is further understood that various changes, modifications and rearrangements may be made without departing from the scope of the invention as defined in the appended claims. For example, and referring particularly to FIG. 4, if sleeve 40 is of sufficient cross-sectional diameter whereby to engage a major portion of a handle element sidewall (not shown), appendages 42 and pressure plate 43 may be omitted from the alternate embodiment. Still further, appendages 42 are only illustrative and not intended to limit additional alternate embodiments for said sleeve 40. Any substantially similar sleeve may be used which has means at one end thereof accommodated within conformable recesses partially disposed through said pressure plate, whereby to prevent said plate from rotating. Therefore, to the extent variant forms of my invention are possible, such variant forms are considered to be within the scope and essence of my invention.

What is claimed is:

1. A device for exercising the arm muscles, comprising:

(a) an elongated shaft having a retainer at one end and being threaded along a portion of the opposite end, said shaft having, intermediate said retainer and threaded end portion, a slot transversely disposed therethrough and elongated along the longitudinal axis thereof;

(b) a handle assembly comprising at least two tubular members surmounted upon said shaft and each adapted for relative rotating movement thereabout, the longitudinal dimension of said handle assembly as mounted on said shaft being less than the distance between said retainer and said slot;

(c) an adjustable housing member having a threaded recess comfortably accommodating said threaded end portion;

(d) friction-producing means responsive to adjustment of said housing member for urging said tubular members of said handle assembly into friction-producing abutment, said means comprising a sleeve member surmounted upon said shaft intermediate said handle assembly and housing member, the surface portion of said sleeve member proximate said handle assembly having a transverse cross-section which is non-circular, said sleeve member having a bore transversely disposed therethrough which is coaxially aligned with said slot through said shaft, said bore further having a cross-sectional dimension along the longitudinal axis of said shaft which is less than the elongated dimension of said slot, and a pin member secured within said bore and communicating through said slot which permits said sleeve to move relative to said shaft only along the longitudinal axis of the latter thereby preventing said adjustable housing member from rotating about said threaded end portion in response to rotation of said tubular members about said shaft so as to prevent the disengagement of said tubular members from said friction-producing abutment; and (e) a friction-producing plate member surmounted upon said shaft intermediate said handle assembly and said sleeve member, said plate member having a recess extending inwardly therein which is adapted to conformably accommodate said non-circular portion of said sleeve member whereby to prevent relative rotating movement therebetween.

2. An exercise device as set forth in claim 1, further comprising a friction-producing washer element surmounted upon said shaft intermediate the adjacent sidewalls of said tubular members of said handle assembly.

3. An exercise device as set forth in claim 2 further comprising a second friction-producing washer element surmounted upon said shaft intermediate said retainer and said handle assembly.

4. An exercise device as set forth in claim 1, further comprising a friction-producing washer element surmounted upon said shaft intermediate said retainer and said handle assembly.

* * * * *